US010604396B2

(12) United States Patent
Liao

(10) Patent No.: US 10,604,396 B2
(45) Date of Patent: Mar. 31, 2020

(54) FUNNEL

(71) Applicant: LIH YANN INDUSTRIAL CO., LTD., Taichung (TW)

(72) Inventor: Po-Lin Liao, Taichung (TW)

(73) Assignee: LIH YANN INDUSTRIAL CO. LTD., Taichung (TW)

( * ) Notice: Subject to any disclaimer, the term of this patent is extended or adjusted under 35 U.S.C. 154(b) by 8 days.

(21) Appl. No.: 15/957,590

(22) Filed: Apr. 19, 2018

(65) Prior Publication Data

US 2019/0322515 A1 Oct. 24, 2019

(51) Int. Cl.
*B67C 11/04* (2006.01)
*B67C 11/02* (2006.01)
*B67C 11/00* (2006.01)

(52) U.S. Cl.
CPC ..... *B67C 11/02* (2013.01); *B67C 2011/20* (2013.01); *B67C 2011/30* (2013.01)

(58) Field of Classification Search
CPC ..... B67C 11/02; B67C 2011/30
See application file for complete search history.

(56) References Cited

U.S. PATENT DOCUMENTS 1,705,312 A * 3/1929 Rovano ..... B67C 11/02 141/297
3,973,602 A * 8/1976 Kruse ..... B67C 11/02 141/95
4,273,166 A * 6/1981 Bradley ..... B67C 11/02 141/297
4,494,585 A * 1/1985 Waldecker ..... B67C 11/00 141/297
5,511,595 A * 4/1996 Stidham ..... B67C 11/04 141/297
5,676,185 A * 10/1997 Starr ..... B67C 11/02 141/300
5,787,944 A * 8/1998 Sarkis ..... B67C 11/02 141/300
6,142,193 A * 11/2000 Sanders ..... B65B 39/04 141/300
7,284,581 B2 * 10/2007 Steinweg ..... B67C 11/04 141/331
8,567,456 B1 * 10/2013 Francis ..... B67C 11/02 141/286
9,493,332 B2 * 11/2016 Kraft ..... B67C 11/02
(Continued)

*Primary Examiner* — Reinaldo Sanchez-Medina
(74) *Attorney, Agent, or Firm* — Muncy, Geissler, Olds & Lowe, P.C.

(57) ABSTRACT

A funnel is provided, including a main body and a ventilation passage. The main body is configured to lead a liquid into a receiving container. The main body includes a liquid inlet, a receiving chamber and a liquid outlet. The liquid outlet is configured to be communicated with the receiving container. The ventilation passage is configured to be communicated with the receiving container and external environment. The ventilation passage includes a first passage and a second passage which are communicated with each other. The first passage is integrally formed as a part of the main body. A first end of the first passage is configured to be communicated with the receiving container. The second passage is configured to be communicated with external environment and is detachably assembled to a second end of the first passage.

9 Claims, 5 Drawing Sheets

(56) References Cited

U.S. PATENT DOCUMENTS

| | | | | |
|---|---|---|---|---|
| 2009/0283178 | A1* | 11/2009 | Sun | B67C 11/02 141/337 |
| 2012/0267006 | A1* | 10/2012 | Liao | B67C 11/02 141/331 |
| 2016/0257547 | A1* | 9/2016 | Kraft | B67C 11/02 |

* cited by examiner

FUNNEL

BACKGROUND OF THE INVENTION

Field of the Invention

The present invention relates to a funnel.

Description of the Prior Art

Liquid is easy to flow out when it is transferred from a container to another container by directly pouring, which results in soiled environment, difficult cleaning and other issues. Therefore, some funnels are developed to receive liquid with a larger liquid inlet and transfer the liquid to another container via a main body of the funnel so as to solve the problems described above.

However, although this type of funnels solved the problem that liquid flowed out when the liquid is poured directly, it does not further improve the actual conditions and phenomena that occur when liquid is flowing. There are still deficiencies in actual use, and the conventional funnels cannot meet the needs of users.

The present invention is, therefore, arisen to obviate or at least mitigate the above-mentioned disadvantages.

SUMMARY OF THE INVENTION

The main object of the present invention is to provide a funnel, having a ventilation passage which is integrally formed as a part of the funnel and configured for ventilation of air from a receiving container facilitating pouring of liquid into the receiving container. In addition, the air in the receiving container is less likely to flow into a receiving chamber and faun bubbles, to avoid bubble bursting and liquid splashing.

To achieve the above and other objects, the present invention provides a funnel, including a main body and a ventilation passage. The main body is configured to lead liquid into a receiving container. The main body includes a liquid inlet, a receiving chamber and a liquid outlet. The liquid outlet is configured to be communicated with the receiving container. The ventilation passage is configured to be communicated with the receiving container and external environment. The ventilation passage includes a first passage and a second passage which are communicated with each other. The first passage is integrally formed as a part of the main body. A first end of the first passage is configured to be communicated with the receiving container. The second passage is configured to be communicated with external environment and is detachably assembled to a second end of the first passage.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
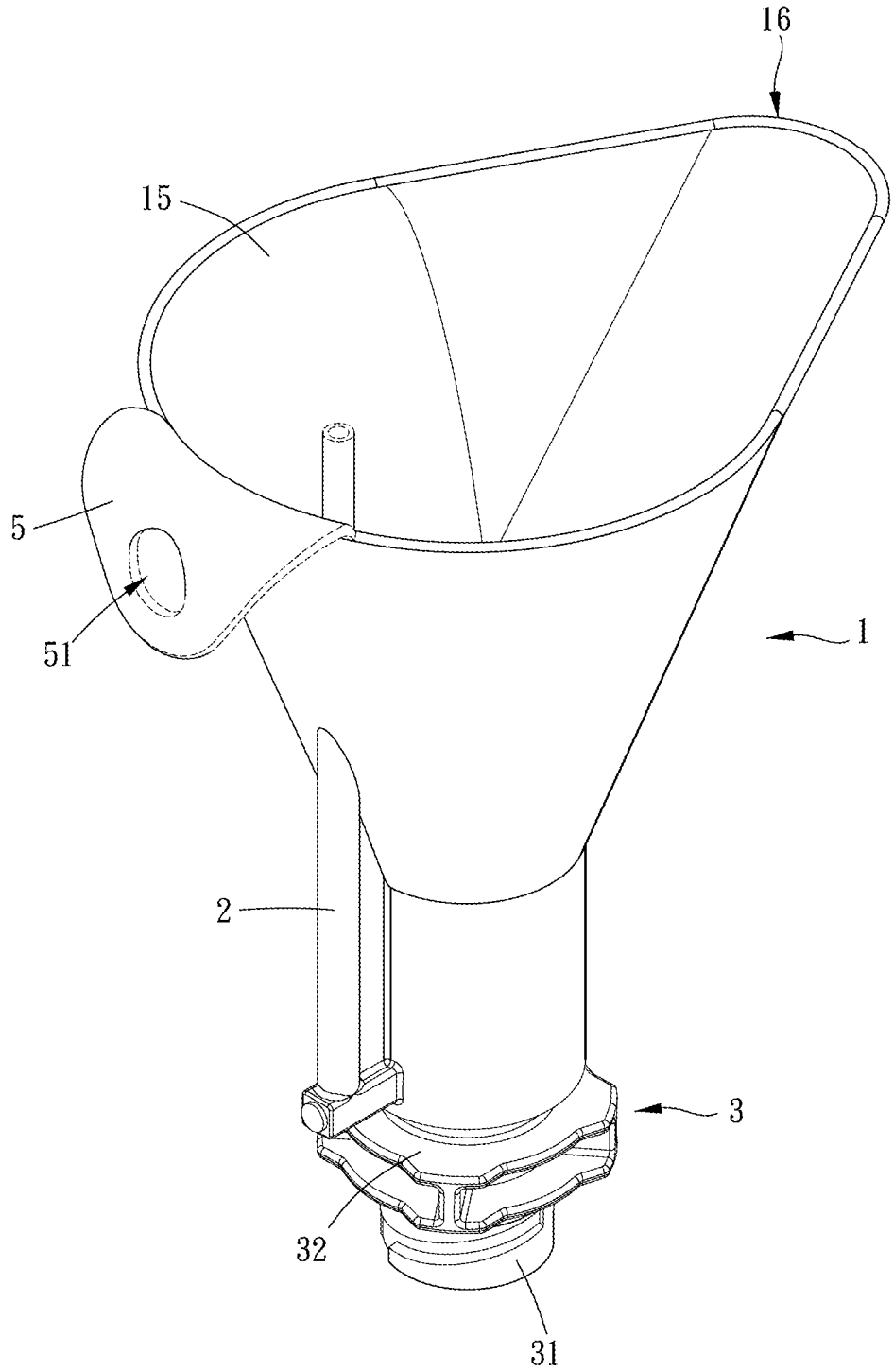
FIG. 1 is a stereogram of a preferable embodiment of the present invention.
Figure 2:
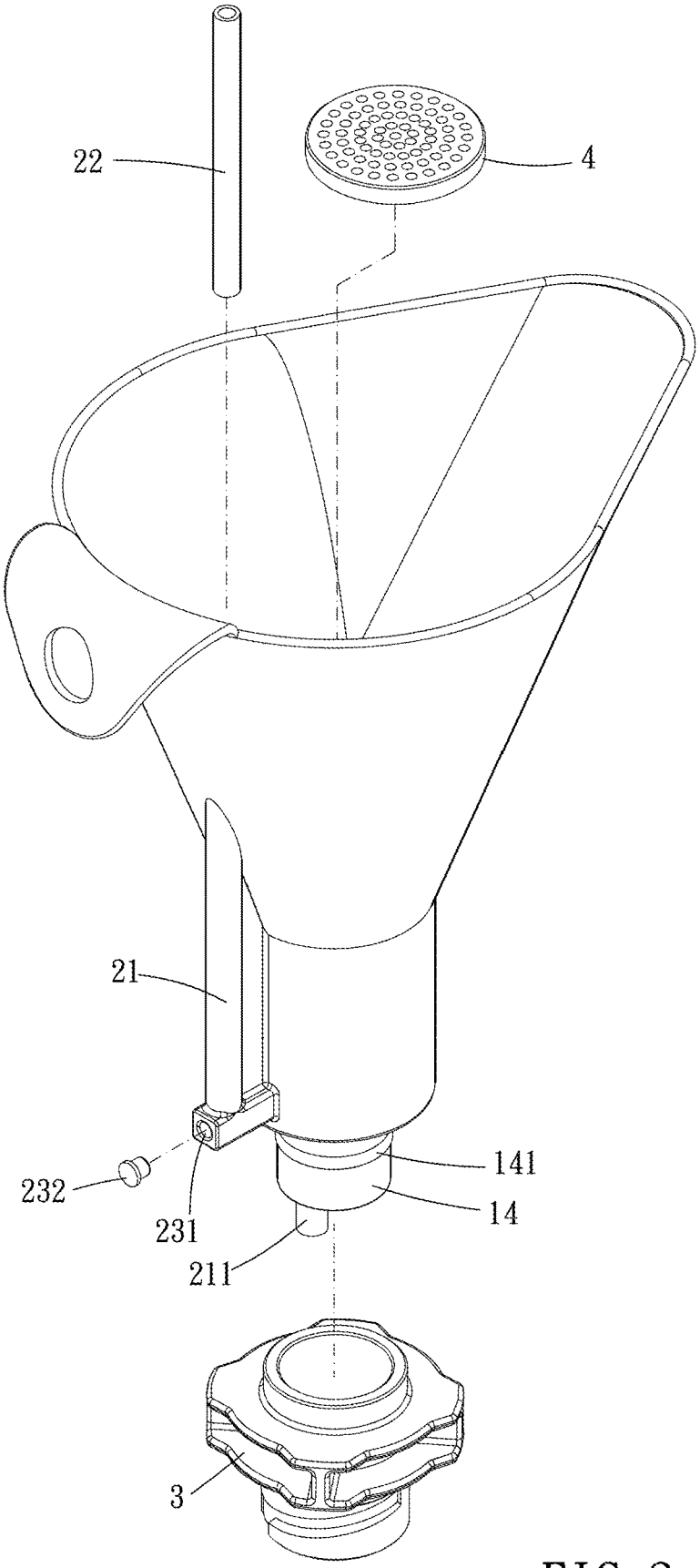
FIG. 2 is a breakdown drawing of FIG. 1.
Figure 3:
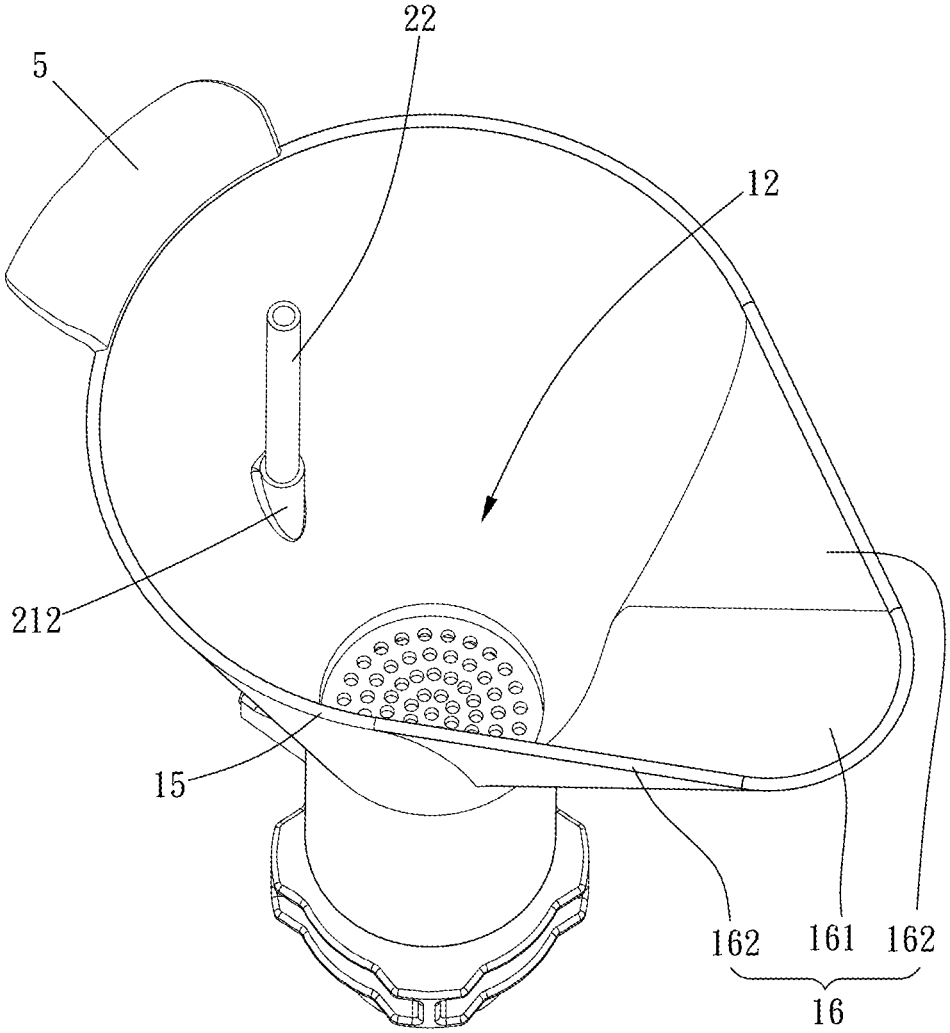
FIG. 3 is a top view of FIG. 1.
Figure 4:
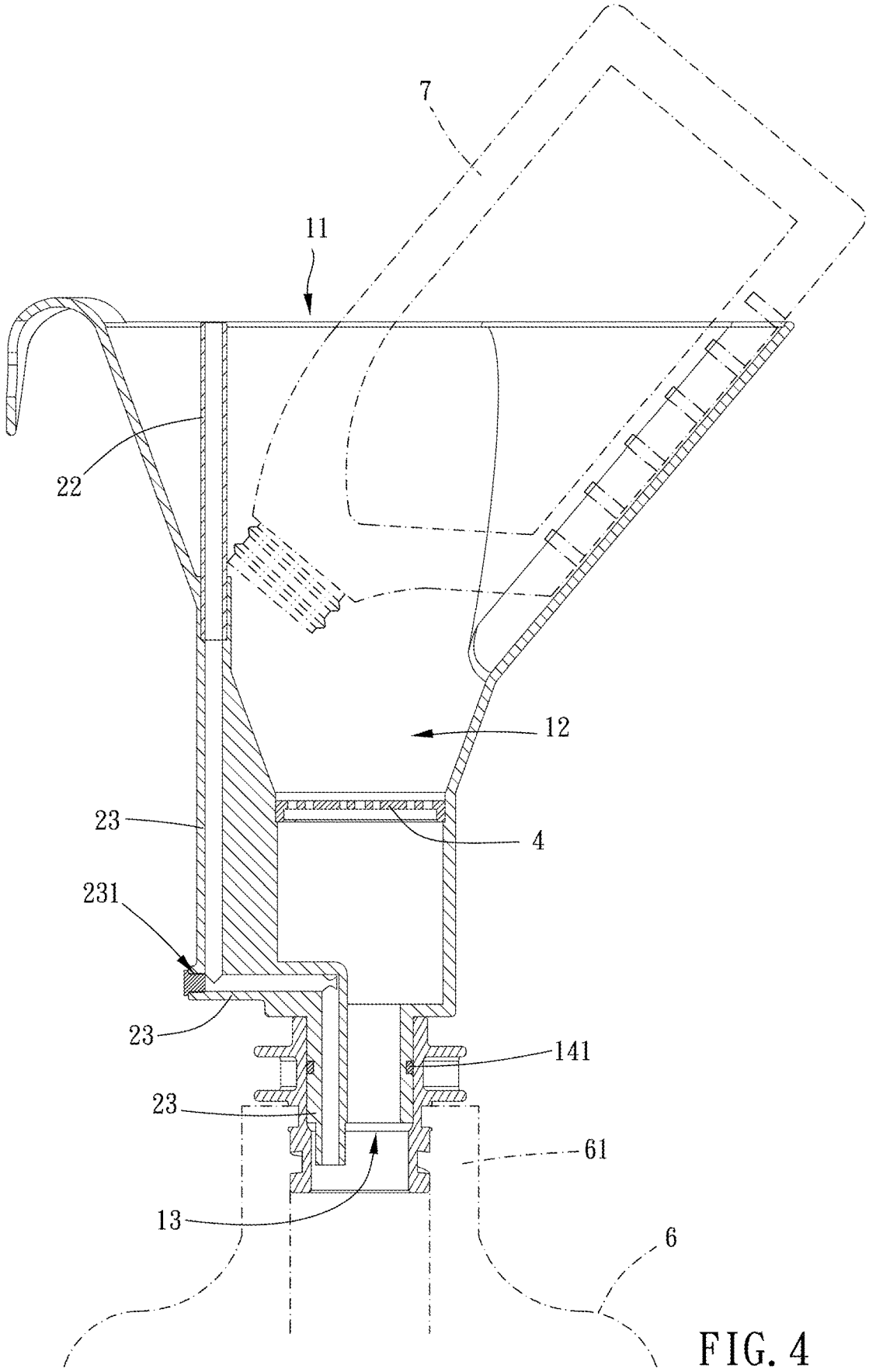
FIG. 4 is a cross-sectional view of FIG. 1 in use.

Please refer to FIGS. 1 to 5 for a preferable embodiment of the present invention. A funnel 1 of the present invention includes a main body 1 and a ventilation passage 2.

The main body 1 is configured to lead liquid into a receiving container 6. The main body 1 includes a liquid inlet 11, a receiving chamber 12 and a liquid outlet 13 which are communicated with one another. The liquid outlet 13 is configured to be communicated with the receiving container 6. The ventilation passage 2 is configured to be communicated with the receiving container 6 and external environment. The ventilation passage 2 includes a first passage 21 and a second passage 22, and the first passage 21 is integrally formed as a part of the main body 1. A first end 211 of the first passage 21 is configured to be communicated with the receiving container 6. The second passage 22 is configured to be communicated with external environment and is detachably assembled to a second end 212 of the first passage 21.

The ventilation passage 2 allows gas to flow in a direction opposite to that of the liquid along a path different that of the liquid so that the gas in the receiving container 6 is able to be smoothly discharged to external environment and does not block the liquid from flowing into the receiving container 6 and so that bubbles due to mixing of the gas, the liquid and translation of the bubbles from the liquid outlet 13 toward the receiving chamber 12 and bursting and splashing of the liquid near the liquid inlet 11 can be prevented.

Furthermore, the main body 1 further includes a surrounding portion 15 and a mouth portion 16. The surrounding portion 15 and the mouth portion 16 define the receiving chamber 12 and the liquid inlet 11. The mouth portion 16 is tapered outwardly and protrudes from the surrounding portion 15. A maximum included angle between the mouth portion 16 and an axis line of an opening of the liquid inlet 11 is larger than that between the surrounding portion 15 and the axis line of the opening of the liquid inlet 11. The mouth portion 16 with larger included angle can be applied a narrow space to receive the liquid so that the funnel are suitable for various environments.

Moreover, the mouth portion 16 includes a resting portion 161 and two wing portions 162. The resting portion 161 is configured for a pouring container 7 (such as oil bottle) to lean thereon, and the two wing portions 162 are symmetrically disposed on opposite sides of the resting portion 161 and connected to the surrounding portion 15. Furthermore, the resting portion 161 is lower than the two wing portions 162 to form a valley shape so as to receive a part of the pouring container 7, and the two wing portions 162 can stably support the pouring container 7.

It is worth mentioning that the first passage 21 is integrally formed as a part of the main body 1 so that the funnel has a continuous, integral and firm structure. There is no assembly gap on the main body 1 so that the liquid in the receiving chamber 12 will not leak out. Moreover, the main body 1 is not necessary for additional assembly when being manufactured so that the production steps are effectively simplified so as to achieve rapid production.

Through connecting the second passage 22 with the first passage 21, the main body 1 is more likely to be successfully demolded during plastic injection molding and not broken due to a long length of the ventilation passage 2. The second passage 22 is removable when it is not in use so that the receiving chamber 12 has more integral space to receive other items to make more efficient use of space. Additionally, when the ventilation passage 2 is blocked, the second passage 22 is removable to reduce a length to be cleaned so that the ventilation passage 2 is able to be rapidly cleaned up without using special tools.

The liquid inlet 11 and the liquid outlet 13 are parallel, and the main body 1 is tapered from the liquid inlet 11 toward the liquid outlet 13. The first end 211 of the first passage 21 protrudes beyond the liquid outlet 13. Therefore, the first end 211 can reach deep inside the receiving container 6 so that air in the receiving container 6 can certainty flow into the ventilation passage 2 via the first end 211. The second end 212 of the first passage 21 extends into the receiving chamber 12 to be assembled with the second passage 22 and communicated with external environment. The second end 212 of the first passage 21 and the second passage 22 are located in the receiving chamber 12 to reduce a volume occupied by the funnel.

Moreover, the second passage 22 is made of flexible materials so that the second passage 22 is not easy to be broken and can maintain whole structure of the second passage 22 when collided by unexpected forces. In this embodiment, a length of the second passage 22 is 2 to 4 times a length of the first passage 21 in the opening direction of the liquid inlet 11.

Considering ease of manufacturing, the first passage 21 is divided into at least two extending segments 23, and every adjacent two of the at least two extending segments 23 extend perpendicularly relative to each other. For example but not limitation, the first passage 21 is divided into three extending segments 23, and the three extending segments include first, second and third extending segments. The first extending segment 23 extends along an opening direction of the liquid inlet 11 and is disposed through the liquid outlet 13. The second extending segment 23 extends along the opening direction of the liquid inlet 11 and into the receiving chamber 12. It means that the first end 211 is located at the first extending segment 23 and the second end 212 is located at the second extending segment 23. Besides, the third extending segment 23 is perpendicularly communicated to the first and the second extending segments 23.

In this embodiment, the third extending segment 23 further has a through hole 231 which is disposed through the main body 1. When a foreign matter is in the ventilation passage 2, the through hole 231 can assist in cleaning the ventilation passage 2, and the foreign matter can be discharged through the through hole 231. Moreover, a stopper 232 is detachably blocked the through hole 231 for blocking between the third extending segment 23 and external environment. The stopper 232 is removable to allow air to flow out via the through hole 231 when the second passage 22 is blocked. Moreover, a distance between an axis line of the first extending segment 23 and an axis line of the second extending segment 23 is 0.15 to 0.19 times the maximum distance of the liquid inlet 11 for better exhaust smoothness.

Preferably, a hanging member 5 is disposed on the main body 1 to be hanged on objects. The funnel, in use, can be hung on surrounding objects to assist positioning and, not in use, be hung to avoid unexpected collision. Preferably, the hanging member 5 has a penetration hole 51 which is configured to be hooked by a hook body of external environment, thus providing various hanging modes.

Furthermore, the funnel further includes filter 4 which is positioned between the receiving chamber 12 and the liquid outlet 13. The filter 4 is configured to filter the liquid which enters the receiving chamber 12 from the liquid inlet 11 and flows toward the liquid outlet 13 to separate solids from the liquid. Preferably, the filter 4 is disc-shaped and the liquid outlet 13 is circular. In this embodiment, the filter 4 is larger than the liquid outlet 13 in radial dimension for appropriate filtering cross-sectional area. Preferably, a distance between the filter 4 and the liquid inlet 11 is 1.1 to 1.4 times a distance between the filter 4 and the liquid outlet 13.

Moreover, the funnel further includes an adapter 3 and the main body 1 further includes a head part 14. The liquid outlet 13 is disposed through the head part 14, and the adapter 3 is disposed on the head part 14 and configured to be connected with an opening portion 61 of the receiving container 6. The adapter 3 allows the main body 1 to be firmly and positionally connected to the opening portion 61 so that the main body is able to resist external force and not easy to depart from the opening portion 61.

Specifically, the adapter 3 includes a threaded segment 31 and a press portion 32. The threaded segment 31 is configured to be screwed with the opening portion 61 of the receiving container 6, and the press portion 32 is configured to press on opening portion 61 of the receiving container 6. The adapter 3 is tightly connected with the opening portion 61 by screwing. As a result, the adapter 3 and the opening portion 61 are not easy to be separated and the liquid in the receiving container 6 is also not easy to leak out when being shacked. Moreover, since the press portion 32 is pressed on an end surface of the opening portion 61, a contact area between the adapter 3 and the opening portion 61 is increased so that the funnel is not easy to swing by external force.

Specifically, the first end 211 of the first passage 21 protrudes beyond the liquid outlet 13 and extends into the adapter 3 so as to rapidly receive the air in the receiving container 6 and ensure the air can be discharge through the ventilation passage 2 to external environment. The adapter 3 and the head part 14 are preferably rotatably sleeved with each other so that the funnel can be connected to or detached from the receiving container by rotating the adapter 3 without turning the whole main body 1, which is convenient and easy to use.

Figure 5:
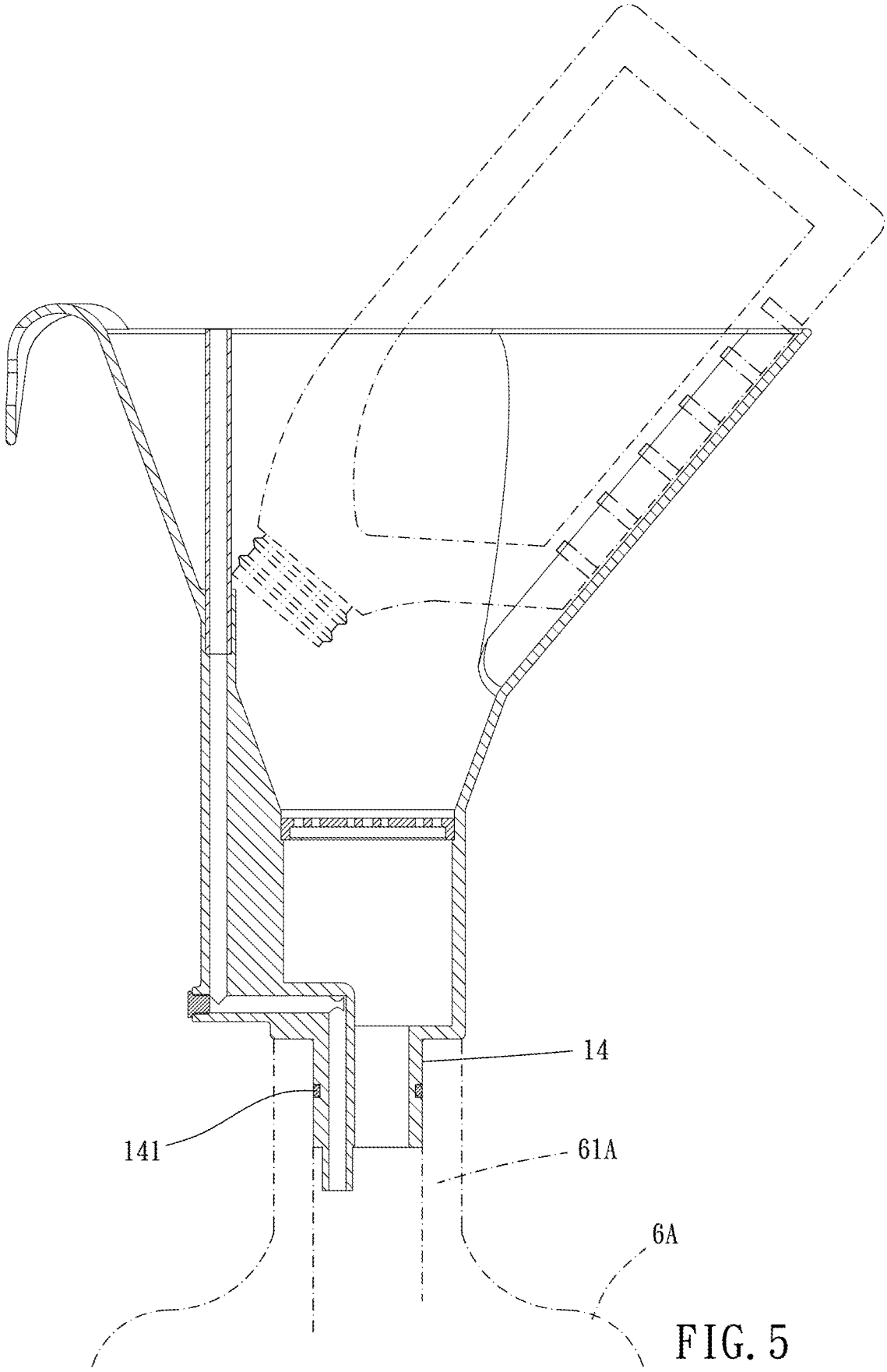
FIG. 5 is another cross-sectional view of a preferable embodiment of the present invention in use.

Preferably, the adapter 3 is detachably sleeved onto the head part 14, and the adapter 3 is changeable according to the radial dimension of the opening portion 61. In use as shown in FIG. 5, the head part 14 is directly inserted into the opening portion 61A of the receiving container 6A without using the adapter 3.

Furthermore, an O-ring 141 is sleeved onto the head part 14. When the head part 14 is sleeved with the adapter 3, the O-ring 141 is tightly abutted against an inner wall of the adapter 3 to avoid the adapter 3 to depart from the head part 14 easily due to unexpected force. That is, the O-ring 141 has a tight fit effect. The O-ring 141 is able to prevent leakage in use as shown in FIG. 5.

In summary, the first passage is integrally formed as a part of the main body in this invention so that the funnel is not necessary to be assembled so as to simplify manufacturing process. The main body has a continuous structure without assembly gaps to prevent the liquid from leaking out through the assembly gaps.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A funnel, including:

a main body, configured to lead liquid into a receiving container, including a liquid inlet, a receiving chamber and a liquid outlet which are communicated with one another, the liquid outlet being configured to be communicated with the receiving container;

a ventilation passage, configured to be communicated with the receiving container and external environment, including a first passage and a second passage which are communicated with each other, the first passage being integrally formed as a part of the main body, a first end of the first passage being configured to be communicated with the receiving container, the second passage being configured to be communicated with external environment and being detachably assembled to a second end of the first passage;

wherein the first end of the first passage extends to the liquid outlet, the second end of the first passage extends into the receiving chamber, and an opening of the second end of the first passage is open toward and within the receiving chamber.

2. The funnel of claim 1, wherein the first passage is divided into at least two extending segments, the at least two extending segments extend perpendicularly relative to each other.

3. The funnel of claim 1, further including an adapter, wherein the main body further includes a head part, the liquid outlet is disposed through the head part, and the adapter is disposed on the head part and configured to be connected with an opening portion of the receiving container.

4. The funnel of claim 3, wherein the first end of the first passage protrudes beyond the liquid outlet and extends into the adapter.

5. The funnel of claim 3, wherein the adapter and the head part are rotatably sleeved with each other.

6. The funnel of claim 1, wherein the main body further includes a surrounding portion and a mouth portion, the surrounding portion and the mouth portion define the receiving chamber and the liquid inlet, the mouth portion is tapered outwardly and protrudes from the surrounding portion; a maximum included angle between the mouth portion and an axis line of an opening of the liquid inlet is larger than that between the surrounding portion and the axis line of the opening of the liquid inlet.

7. The funnel of claim 6, wherein the mouth portion includes a resting portion and two wing portions, the resting portion is configured for a pouring container to lean thereon, and the two wing portions are symmetrically disposed on opposite sides of the resting portion and connected to the surrounding portion.

8. The funnel of claim 1, further includes a filter, wherein the filter is positioned between the receiving chamber and the liquid outlet, and the filter is configured to filter the liquid which enters the receiving chamber from the liquid inlet and flows toward the liquid outlet.

9. The funnel of claim 7, wherein the first end of the first passage extends to the liquid outlet, the second end of the first passage extends into the receiving chamber; the funnel further includes an adapter, the main body further includes a head part, the liquid outlet is disposed through the head part, and the adapter is disposed on the head part and is configured to be connected with an opening portion of the receiving container; the first end of the first passage protrudes beyond the liquid outlet and extends into the adapter; the adapter and the head part are rotatably sleeved with each other; the funnel further includes a filter, the filter is positioned between the receiving chamber and the liquid outlet, and the filter is configured to filter the liquid which enters the receiving chamber from the liquid inlet and goes toward the liquid outlet; the resting portion is lower than the two wing portions to form a valley shape so as to receive a part of the pouring container; the main body is tapered from the liquid inlet toward the liquid outlet; the filter is disc-shaped and the liquid outlet is circular; a diametrical dimension of the filter is larger than a diametrical dimension of the liquid outlet; the first passage is divided into three extending segments, and every adjacent two of the three extending segments extend perpendicularly relative to each other; the three extending segments includes first, second and third extending segments; the first extending segment extends along an opening direction of the liquid inlet and is disposed through the liquid outlet; the second extending segment extends along the opening direction of the liquid inlet and into the receiving chamber; the third extending segments is perpendicularly communicated to the first and the second extending segments and has a through hole which is disposed through the main body; a stopper is detachably blocked the through hole for blocking between the third extending segment and external environment; an O-ring is sleeved onto the head part; the adapter includes a threaded segment and a press portion; the threaded segment is configured to be screwed with the opening portion of the receiving container, and the press portion is configured to press on the opening portion of the receiving container; a distance between an axis line of the first extending segment and an axis line of the second extending segment is 0.15 to 0.19 times the maximum distance of the liquid inlet; a distance between the filter and the liquid inlet is 1.1 to 1.4 times a distance between the filter and the liquid outlet; a length of the second passage is 2 to 4 times a length of the first passage in the opening direction of the liquid inlet; the second passage is made of flexible materials; a hanging member is disposed on the main body to be hanged on objects; the hanging member has a penetration hole which is configured to be hooked by a hook body of external environment; the first end is located at the first extending segment and the second end is located at the second extending segment; the adapter is detachably sleeved onto the head part.

* * * * *